US005611601A

United States Patent [19]

Cowgur

[11] Patent Number: 5,611,601

[45] Date of Patent: Mar. 18, 1997

[54] METHOD AND MEANS FOR FACILITATING REST FOR A PERSON IN A SITTING POSITION

[75] Inventor: Bruce E. Cowgur, Rochester, Ill.

[73] Assignee: Brex, Inc., West Des Moines, Iowa

[21] Appl. No.: 227,722

[22] Filed: Apr. 14, 1994

[51] Int. Cl.[6] ..... A47C 1/10

[52] U.S. Cl. ..... 297/393; 297/DIG. 3

[58] Field of Search ..... 297/4, 393, 411.2, 297/452.41, DIG. 3, DIG. 6, 487, 488; 5/449, 455, 480, 652, 654, 655.3

[56] References Cited

U.S. PATENT DOCUMENTS

| | | | |
|---|---|---|---|
| 623,548 | 4/1899 | Hurdel | 5/449 |
| 2,829,386 | 4/1958 | Peer | 297/4 X |
| 2,987,735 | 6/1961 | Nail | 297/452.41 X |
| 3,017,642 | 1/1962 | Rosenberg et al. | 297/DIG. 3 X |
| 3,029,109 | 4/1962 | Nail | 297/DIG. 3 X |
| 4,025,105 | 5/1977 | Pekala | 297/4 |
| 4,232,477 | 11/1980 | Lin | 297/DIG. 3 X |
| 4,235,472 | 11/1980 | Sparks et al. | 297/392 |
| 4,774,735 | 10/1988 | Sanderson et al. | 297/DIG. 3 X |

*Primary Examiner*—Milton Nelson, Jr.

*Attorney, Agent, or Firm*—Zarley, McKee, Thomte, Voorhees & Sease

[57] ABSTRACT

A rest pillow for facilitating rest for a person in a sitting position comprises an inflated flexible substantially rectangular compartment having top, bottom, front and rear portions and opposite side portions. An inflation port is located in the compartment to selectively inflate or deflate the compartment. A strap is secured by its ends to the sides of the compartment for securing the compartment to the waist of the person using it. A plurality of baffles extend from the front interior of the compartment to the rearward portion thereof to prevent the compartment from becoming substantially distorted when the person using the device rests his or her head on the top portion thereof. The method for facilitating rest of a person in a sitting position, comprises the steps of placing an inflated substantially rectangular flexible compartment on the lap of a sitting person, causing the person to lean forward to rest the person's head and arms on the top of the compartment to bind the compartment between the head and arms, and the lap of the person, and to provide resting support for the person's head and arms.

1 Claim, 1 Drawing Sheet

METHOD AND MEANS FOR FACILITATING REST FOR A PERSON IN A SITTING POSITION

BACKGROUND OF THE INVENTION

Resting and sleeping while in a sitting position on an airplane, automobile, or the like, is difficult for many and impossible for some. This is principally because there is no adequate means for supporting a person's head and shoulders in a stable position while the person is sleeping.

It is therefore a principal object of this invention to provide a method and means for facilitating rest and sleep for a person in a sitting position primarily within a traveling vehicle.

A further object of this invention is to provide a method for facilitating rest for a person in a sitting position which can be easily and quickly implemented.

A still further object of this invention is to provide a means for facilitating rest for a person in a sitting position which is compact and easily stored when not in use.

A still further object of this invention is to provide a means for facilitating rest for a person in a sitting position which is safe and which easily accommodates the space requirements surrounding the seat in most vehicles.

These and other objects will be apparent to those skilled in the art.

SUMMARY OF THE INVENTION

The rest pillow of this invention comprises an inflated flexible substantially rectangular compartment having top, bottom, front and rear portions and opposite side portions. An inflation port is located in the compartment to selectively inflate or deflate the compartment.

A strap means is secured by its ends to the sides of the compartment for securing the compartment to the waist of the person using it. A plurality of baffles extend from the front interior of the compartment to the rearward portion thereof to prevent the compartment from becoming substantially distorted when the person using the device rests his or her head on the top portion thereof.

The method of this invention comprises placing an inflated substantially rectangular flexible compartment on the lap of a sitting person, causing the person to lean forward to rest the person's head and arms on the top of the compartment to bind the compartment between the head and arms, and the lap of the person, and to provide resting support for the person's head and arms.

A BRIEF DESCRIPTION OF THE DRAWINGS

DESCRIPTION OF THE PREFERRED EMBODIMENT

Figure 1:
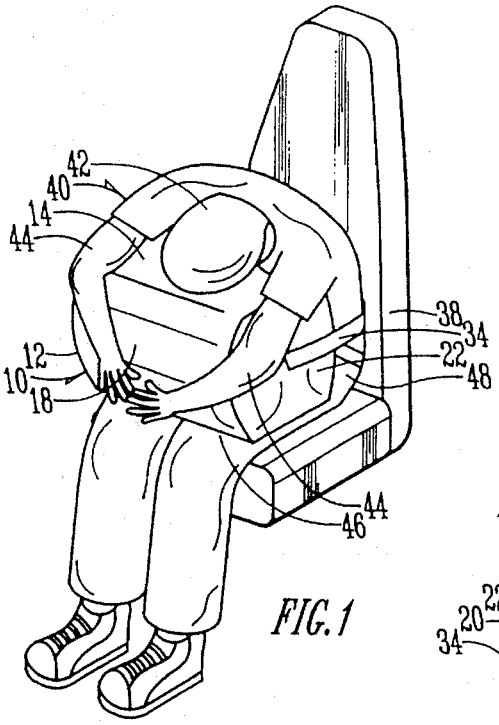
FIG. 1 is a perspective view of a person sitting in a seat and utilizing the rest pillow of this invention for sleeping purposes.
Figure 4:
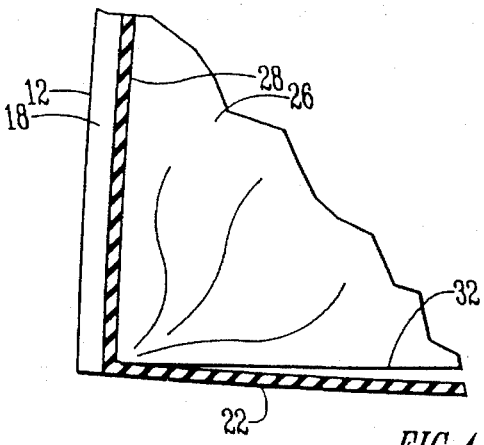
FIG. 4 Is an enlarged scale sectional view of the rest pillow taken on line 4—4 of FIG. 2.
Figure 3:
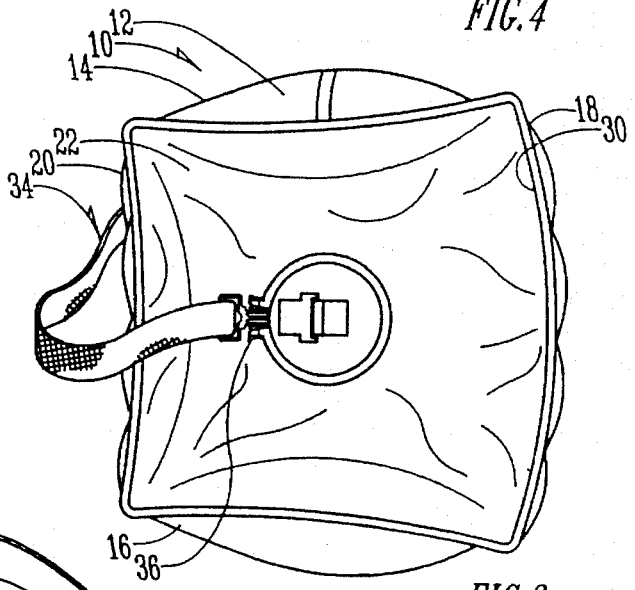
FIG. 3 is a reduced scale side view of the device of FIG. 2.
Figure 2:
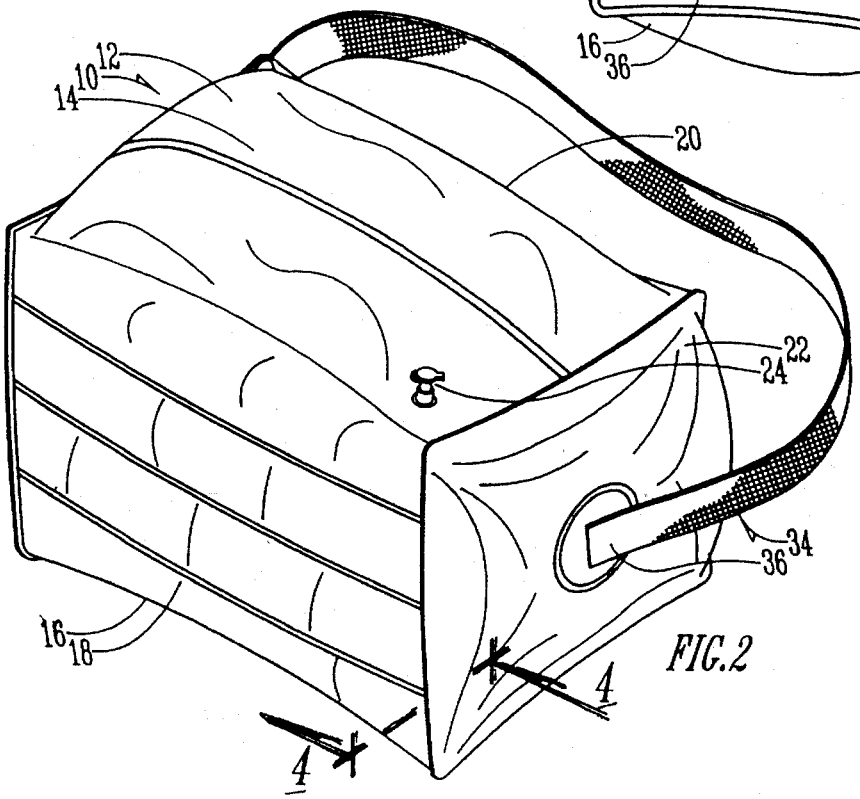
FIG. 2 is an enlarged scale perspective view of the rest pillow of this invention.

The rest pillow 10 comprises an inflatable compartment 12 having a top 14, a bottom 16, front portion 18, rear portion 20, and side portions 22. The compartment is substantially rectangular in shape. An inflation port or valve 24 is located in the top 14 of the compartment. The compartment normally can be inflated by the person using the device who can blow air into the compartment through valve 14 in the same way that a balloon would be inflated.

Three baffle sheets 26 having forward ends 28, and rearward ends 30, with side edges 32 extend between the front portion 18 and the rear portion 20 of compartment 12. The baffle sheets are located within the interior of the compartment and are secured by their forward and rearward ends 28 which are secured in any convenient fashion to the interior surfaces of the front portion 18 and rear portion 20, respectively, of the compartment 12. The side edges 32 of the baffle sheets are not secured to the interior sides 22 of the compartment so that when the device is inflated and deflated, air may move past the baffle sheets and between the edges 32 and the interior surface of compartment sides 22.

A length-adjustable strap 34 having ends 36 is secured in any convenient fashion to the center portions of sides 22 of compartment 12. When in use, the strap 34 is extended around the waist of the person using the device as will be described hereafter.

With reference to FIG. 1, a vehicle seat 38 supports a person 40 who is sitting in the seat. The numerals 42, 44, 46 and 48 designate the head, arms, lap and waist, respectively, of the person utilizing the rest pillow 10.

The compartment 12 is comprised of a flexible plastic material as are baffle sheets 26. This permits the compartment, when deflated, to be folded into a compact size for storage or transportation.

To use the rest pillow 10, the compartment is unfolded from its storage condition, and the user merely opens the valve 24 and blows air within the compartment to inflate it to the position shown in the drawings. The air pressure within the compartment should normally not exceed the ambient air pressure surrounding the compartment so that the compartment will be pliable and flexible for added comfort to the user.

The person using the rest pillow will place the pillow on his or her lap. The vertical height of the pillow preferably should span the vertical distance between the person's lap and a horizontal plane passing through the underarms of the user. If desired, the strap 34 can be extended around the waist of the person in a taut condition so to further insure the stability of the compartment on the lap.

The person using the device can then lean forward as shown in FIG. 1 so that the head and/or arms are substantially supported on the top 14 of the compartment. The weight of the person's head and/or arms tends to bind the inflated compartment 12 between the person's head and lap.

The depth of the compartment 12 measured between the front portion 18 and the rear portion 20 normally should be no greater than the breadth of the person's lap.

As is clear from the foregoing description, the rest pillow will easily enable the person using it to rest or sleep while in a sitting position. The comfort of the rest pillow will facilitate resting or sleeping.

When it is desired to store the rest pillow after being so used, the port 24 is opened so that the air within the compartment can escape. The belt 34 is detached from the waist of the user, and the device is folded into a compact condition.

From the foregoing, it is seen that this device which will achieve at least all of its stated objectives.

What is claimed is:

1. A method of facilitating the rest and sleep of a sitting person, comprising, unfolding an assembled folded flexible compartment having an air valve, and having a rectangular configuration, including a top, having the person blow air into said compartment through said air valve to inflate said compartment so that the vertical height of said compartment will span the distance between the person's lap and a horizontal plane passing through the underarms of the user, securing said compartment to the waist of said person, causing the person to lean forwardly to rest the person's head and arms on the top of said compartment between the head and the arms, and the lap of said person, to bind the inflated compartment between the persons head and lap, allowing the person to rest for a period of time, band then deflating said compartment, and folding the same into a compact size for storage.

* * * * *